United States Patent [19]

Wallace

[11] 4,289,446

[45] Sep. 15, 1981

[54] CERAMIC FACED OUTER AIR SEAL FOR GAS TURBINE ENGINES

[75] Inventor: Matthew J. Wallace, North Palm Beach, Fla.

[73] Assignee: United Technologies Corporation, Hartford, Conn.

[21] Appl. No.: 52,634

[22] Filed: Jun. 27, 1979

[51] Int. Cl.[3] ..... F28D 19/00

[52] U.S. Cl. ..... 415/174; 277/96.2

[58] Field of Search ..... 415/174, 170 R; 277/233, 234, 235 A, 133, 134, 96.2, DIG. 6

[56] References Cited

U.S. PATENT DOCUMENTS

| | | | |
|---|---|---|---|
| 3,817,719 | 6/1974 | Meriden | 75/231 |
| 3,879,831 | 5/1975 | Rigney | 415/174 |
| 3,887,201 | 6/1975 | Rao | 277/96.2 |
| 3,918,925 | 11/1975 | McComas | 428/612 |
| 3,936,656 | 2/1976 | Middleton | 219/118 |
| 3,975,165 | 8/1976 | Elbert | 415/174 |
| 4,080,204 | 3/1978 | Panzera | 415/174 |
| 4,093,243 | 6/1978 | Kishida | 277/96.2 |
| 4,109,031 | 8/1978 | Marscher | 228/122 |

*Primary Examiner*—Everette A. Powell, Jr.
*Attorney, Agent, or Firm*—Robert C. Walker

[57] ABSTRACT

A durable, outer air seal structure capable of long term, reliable service in a gas turbine engine environment is disclosed. Various construction details which enable the incorporation of high temperature tolerant ceramic materials into the outer air seal structure are developed. The structure is built around a porous, low modulus pad of metallic material which is disposed between the ceramic material and a substrate of solid metallic material. The ceramic material is applied to a preferred density at which the physical properties of modulus of elasticity (E), mean tensile strength (T), coefficient of thermal expansion ($\alpha$) and thermal conductivity (K) impart good thermal shock resistance, erosion resistance and abradability characteristics to the seal structure.

9 Claims, 4 Drawing Figures

FIG. 1
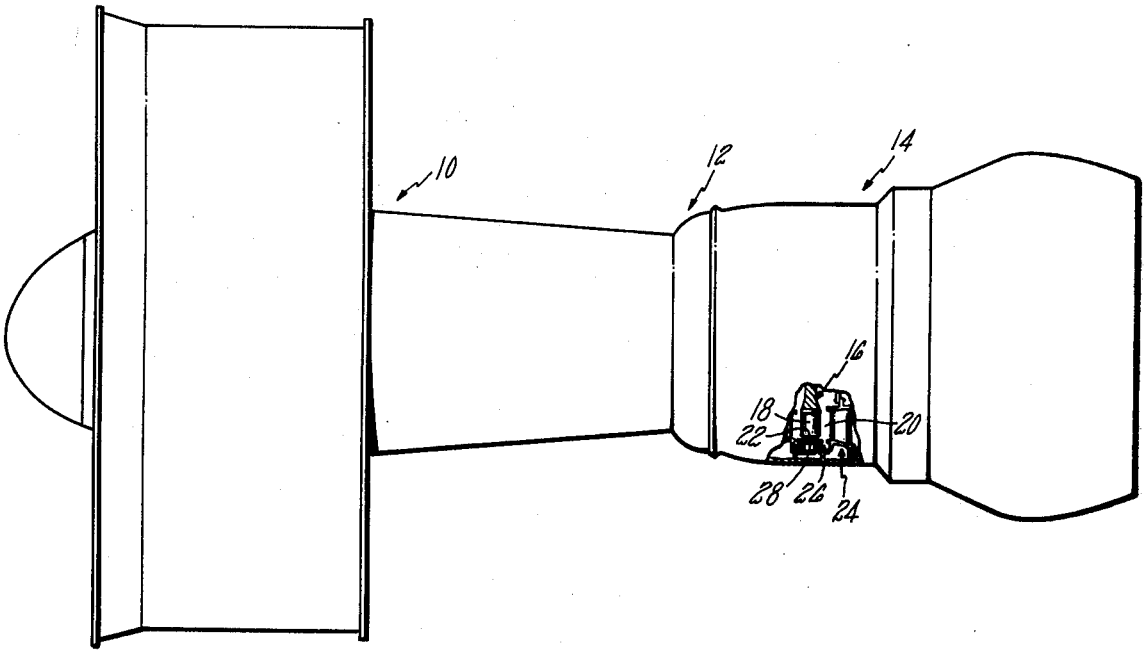
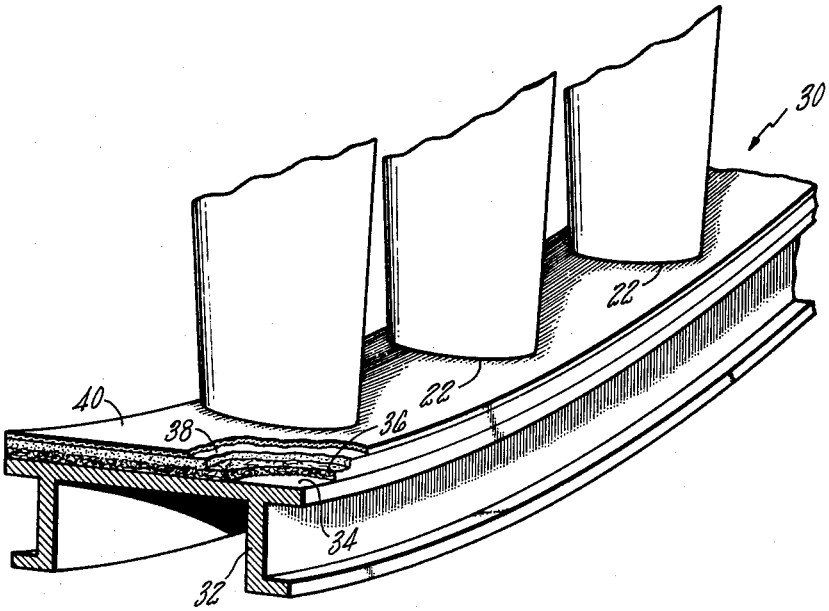
FIG. 2

CERAMIC FACED OUTER AIR SEAL FOR GAS TURBINE ENGINES

BACKGROUND OF THE INVENTION

1. Field of the Invention

This invention relates to ceramic materials and more particularly to ceramic facing materials for gas turbine, outer air seals.

2. Description of the Prior Art

The construction of outer air seals for gas turbine engines has received significant attention in the past and effective embodiments of such seals are continually sought. In an axial flow gas turbine engine, rows of rotor blades in both the compressor and turbine sections of the engine extend radially outwardly on the rotor assembly across a flowpath for working medium gases. An outer air seal which is affixed to the stator assembly circumscribes the tips of the blades and each blade row and inhibits the leakage of working medium gases over the tips of the blades. Each turbine outer air seal is conventionally formed of a plurality of seal segments disposed in end to end relationship about the engine. The tip opposing surfaces of each segment are commonly formed of an abradable material to enable a closely toleranced, initial condition without destructive interference from the blade tips in transient modes. Representative abradable seal lands and methods of manufacture are illustrated in U.S. Pat. Nos. 3,817,719 to Schilke et al entitled "High Temperature Abradable Material and Method of Preparing the Same"; 3,879,831 to Rigney et al entitled "Nickel Base High Temperature Abradable Material"; 3,918,925 to McComas entitled "Abradable Seal"; and 3,936,656 to Middleton et al entitled "Method of Affixing an Abradable Metallic Fiber Material to a Metal Substrate".

Notwithstanding the availability of the aforementioned materials and designs, manufacturers of gas turbine components continue to search for yet improved abradable material constructions having adequate durability in hostile environments. Particularly, within the turbine sections of engines where seal materials are exposed to local temperatures which may exceed twenty-five hundred degrees Fahrenheit (2500° F.), material and structure selections having adequate durability are limited. Ceramic faced seals are of prime interest for these components.

Ceramic materials in general are known to be effective thermal insulators in gas turbine environments and are currently utilized as coating materials for metallic substrates in high temperature environments. As long as the coating materials remain intact, such ceramics prevent unacceptable deterioration of the metallic forms to which they are adhered. Metallic and ceramic materials are not wholly compatible, however, as a large difference in coefficients of thermal expansion between the two material types makes long term adherence of the ceramic to the metal difficult. Typically, subsequent thermal cycling of the finished part in the intended environment causes cracking and spalling of the ceramic from the metal. Such problems are particularly severe where depths of coating in excess of a very few thousandths of an inch are desired.

One ceramic faced seal structure which is adapted to accommodate differences in coefficients of thermal expansion between the ceramic facing material and an underlying metallic substrate is disclosed in U.S. Pat. No. 4,109,031 to Marscher entitled "Stress Relief of Metal-Ceramic Gas Turbine Seals". Graded layers of material in which the relative amounts of metal and ceramic are varied from one hundred percent (100%) metal at the metal interface to one hundred percent (100%) ceramic at the ceramic interface are applied to the metal substrate.

Another type of ceramic faced seal structure is discussed in a paper delivered at the 1976 Joint Fall Meeting of the Basic Science, Electronics and Nuclear Divisions of the American Ceramic Society entitled "Bonding Ceramic Materials to Metallic Substrates for High-Temperature, Low-Weight Applications" and in NASA Technical Memorandum, NASA TM-73852, entitled "Preliminary Study of Cyclic Thermal Shock Resistance of Plasma-Sprayed Zirconium Oxide Turbine Outer Air Seal Shrouds". In accordance with the disclosed systems, a mat of sintered wires joins a ceramic layer to an underlying metallic substrate. The wires form a compliant layer which is capable of accommodating differential thermal expansion between substrate and ceramic layers. In the former structure an alumina ($Al_2O_3$) ceramic material is applied directly to the wire mat. In the latter structure a zirconium oxide ($ZrO_2$) ceramic material is applied over a bond coat of three to five thousandths of an inch (0.003–0.005 in.) to a wire mat and screen.

Although the structures discussed above are known to be highly desirable if adequate ceramic durability can be achieved, the structures have yet to achieve full potential, particularly in hostile environment applications. Significant research into the mechanical properties of the desired ceramic material continues in the search for durable structures.

SUMMARY OF THE INVENTION

A primary aim of the present invention is to provide an effective outer air seal structure of the type utilized in gas turbine engines. Suitability for use in high temperature environments is sought, and a specific object is to provide a ceramic faced component with good resistance to thermal shock.

According to the present invention a ceramic facing material is deposited at a preferred density upon a low modulus pad of porous metallic material to form a durable outer air seal. At the preferred density the ceramic material has a modulus of elasticity (E) and mean tensile strength (T) which provide the ceramic structure with good resistance to thermal shock. In accordance with at least one detailed embodiment, the porous pad has been first impregnated with an MCrAlY type coating to improve the suitability of the pad for adherence of the ceramic facing material.

A principal feature of the structure of the present invention is the ceramic facing material. The facing material opposes the hot, working medium gases of the engine flowpath to provide a seal structure with high temperature capability. The ceramic material in one embodiment is yttria stabilized zirconium oxide which is deposited to a true density of approximately ninety-two percent (92%) of theoretical density. At that density, the ceramic material has the approximately physical property set forth below.

Modulus of Elasticity (E) at 1800° F. $1\times10^6$ lb/in$^2$

Mean tensile strength (T) at 1800° F. 3450 lb/in$^2$

Coefficient of Thermal Expansion ($\alpha$) at 1800° F. $6.06\times10^{-6}$ in/in-°F.

Thermal Conductivity (K) at 1800° F. 5.55 Btu-in/hr-ft$^2$-°F.

In at least one embodiment the ceramic material is adhered to a porous metallic pad which has been first impregnated with MCrAlY coating material. The MCrAlY coating material provides rough surfaces capable of holding the ceramic material onto the outer air seal structure.

A principal advantage of the present invention is the compatibility of the ceramic facing material with the high temperature, hostile environments of gas turbine engines. Minimal amounts of cooling air are required to protect the seal structure. Overall engine performance is increased as the use of decreased amounts of cooling air are required. The structure has adequate abradability characteristics for enabling nondestructive, rubbing interference with the blade tips and is well suited to constructions requiring tight clearances between the blade tips and the outer air seals. Collaterally, the seal structure deposited to the density disclosed has adequate resistance to erosion. Relative thermal growth differences between the ceramic material and the underlying substrate are accommodated by the low modulus pad. Good adherence of the ceramic material to the low modulus pad is obtained by impregnating the pad with an MCrAlY material prior to depositing the ceramic coating on the pad.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a simplified side elevation view of a gas turbine engine including a cutaway portion revealing an outer air seal circumscribing the tips of one row of motor blades in the engine;

FIG. 2 is a perspective view of an outer air seal segment of the present invention;

DETAILED DESCRIPTION

Figure 3:
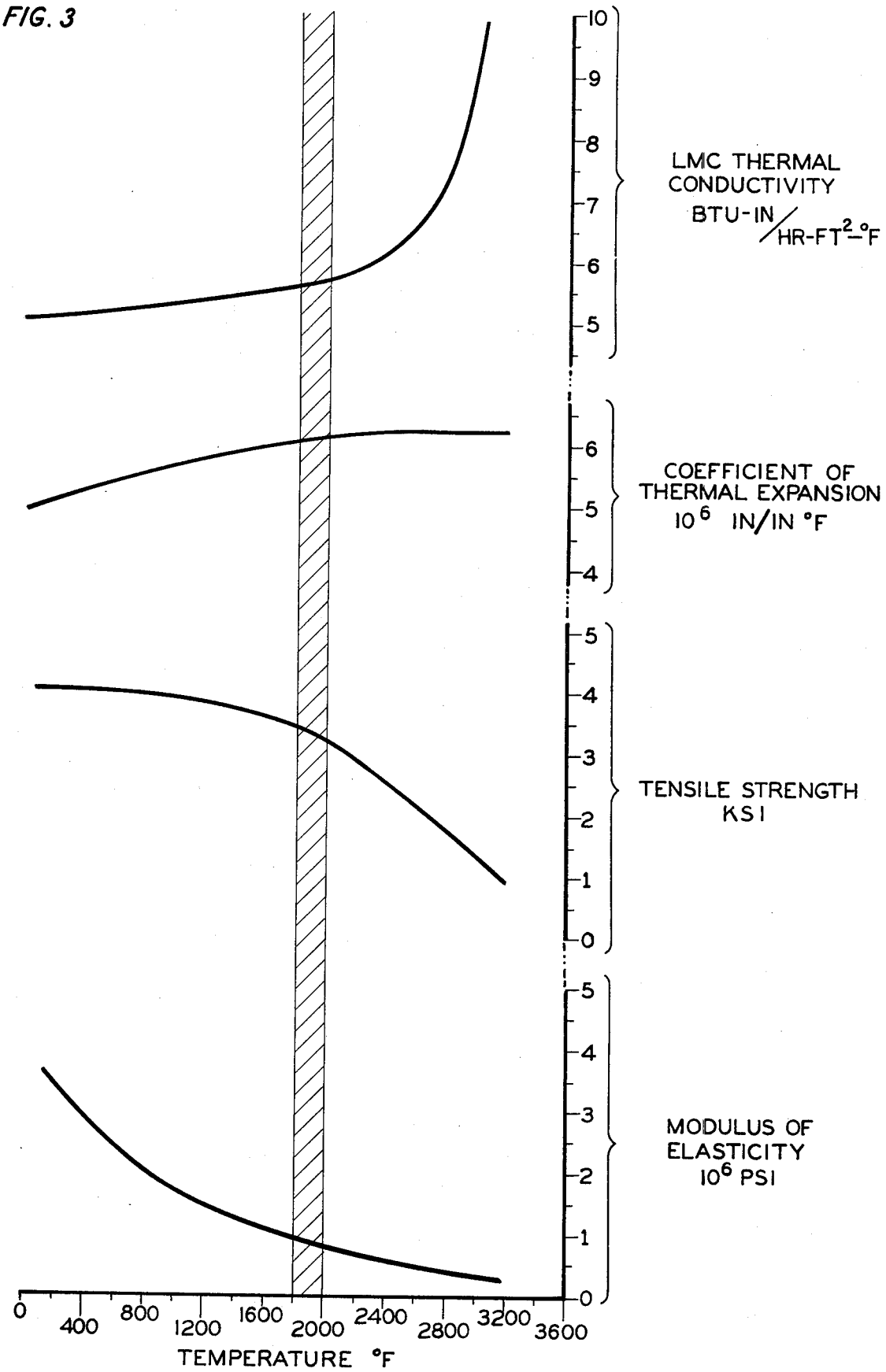
FIG. 3 is a graph illustrating physical properties of one ceramic material sprayed to a preferred density.

A gas turbine engine of the type in which the concepts of the present invention are employable is shown in FIG. 1. The engine principally comprises a compression section 10, a combustion section 12, and a turbine section 14. A rotor assembly 16 extends axially through the engine. Rotor blades 18 are arranged in rows and extend outwardly on the rotor assembly across a flowpath 20 for working medium gases. Each rotor blade has a tip 22.

A stator assembly 24 having a case 26 houses the rotor assembly 16. An outer air seal 28 at each row of rotor blades extends inwardly from the engine case to circumscribe the tips 22 of the blades. Each outer air seal is conventionally formed of a plurality of arcuate segments, as represented by the single segment 30, which are disposed in end to end relationship about the interior of the engine case.

One outer air seal segment 30 fabricated in accordance with the concepts of the present invention is illustrated in FIG. 2. The segment is formed about a solid, metallic substrate 32 having an arcuate surface 34 of the general contour desired in opposition to the blade tips. A porous metallic pad 36 of flexible material having a low modulus of elasticity, such as the wire mesh pad illustrated, is joined to the metal substrate. The low modulus pad is impregnated with an underlying coating 38. A ceramic facing material 40 is adhered to the coated pad. The interface between the metallic underlayment and the ceramic material is identified as interface "A". Properties of the ceramic material at the interface are of critical importance in avoiding crack propagation through the ceramic and are described later in this specification. The metallic substrate may be cooled by suitable means known in the art to prevent the wires of the pad from becoming excessively hot.

In one structure tested and found to be effective the ceramic material consisted nominally of 80 wt % zirconium oxide ($ZrO_3$); and 20 wt. % yttrium oxide ($Y_2O_3$).

The material was deposited by conventional spray apparatus to a depth of sixty thousandths of an inch (0.060 in.) at a true density of ninety-two percent (92%) of theoretical density. The true density was measured in terms of material hardness for purposes of establishing a repeatable quality control standard. The material density desired measures ninety (90) hard on the Rockwell B impact test used extensively throughout industry. The density is expressible in physical terms as five and thirty-six hundredths of a gram per cubic centimeter (5.36 gm/cm$^3$), or the equivalent one hundred ninety-four thousandths of a pound per square inch (0.194 lbs/in$^2$). Ceramic depths within the range of forty to one hundred twenty thousandths of an inch (0.040–0.120 in.) have also been successfully deposited.

Ninety (90) hard material is obtainable by plasma spraying the yttria stabilized zirconium oxide composition with the apparatus and under the conditions described below:

Plasma Spray System

Spray Gun
- Metco 3MG with #3 Powder Port

Power Setting
- Six hundred (600) ampheres seventy (70) volts

Primary Gas
- Nitrogen at eighty (80) cubic feet per hour flow rate and fifty (50) pounds per square inch pressure Secondary Gas
- Hydrogen at five to fifteen cubic feet per hour flow rate and fifty (50) pounds per square inch pressure as required to maintain a voltage of seventy (70) volts across the electrodes

Powder Feeder

Feeder
- Plasmadyne Model #1224 with heater

Powder Flow Rate
- Four (4) pounds per hour

Powder Gas
- Nitrogen at twenty (20) cubic feet per hour flow rate and fifty (50) pounds per square inch pressure

Spray Conditions

Gun Distance
- Six (6) inches

Head Traverse
- Horizontal Rate of fifteen hundredths (0.15) of a foot per second with one hundred twenty-five thousandths (0.125) of an inch vertical step each pass deposits a coating of approximately three thousandths (0.003) of an inch Cooling Gas Cooling Gas Air at fifty (50) pounds per square inch.

Physical properties of the ninety (90) hard are reported on the FIG. 3 graph. Properties at eighteen hundred degrees Fahrenheit (1800° F.) are as follows:

Modulus of Elasticity (E) $1\times10^6$ lbs/in$^2$

Mean Tensile Strength (T) 3450 lbs/in$^2$

Coefficient of Thermal Expansion ($\alpha$) $6.06\times10^{-6}$ in/in-°F.

Thermal Conductivity (K) 5.55 Btu-in/hr-ft$^2$-°F.

Thermal conductivity (K) is an important characteristic of the material. All ceramics have relatively low thermal conductivity and hence their desirability as facing materials is apparent. Substantial temperature gradients across the ceramic can be held for protection of the metal substructures to which the ceramics are adhered. It should be noted in the FIG. 3 graph, however, that thermal conductivity across the ceramic increases sharply at temperatures above two thousand degrees Fahrenheit (2000° F.). Increased thermal conductivity requires increased cooling of the metal substructures to prevent deterioration thereof and is undesirable. Maintenance of the ceramic material at the interface "A" at temperatures below two thousand degrees Fahrenheit (2000° F.) is strongly desired.

Tensile strength (T), modulus of elasticity (E) and coefficient of thermal expansion ($\alpha$) for the ninety (90) hard material are also reported on the FIG. 3 graph. These three factors in large measure determine the ability of the ceramic to resist thermal shock. Thermally induced stresses are proportional to both the modulus of elasticity and the coefficient of thermal expansion. Lower thermal stresses are induced in relatively low modulus, low coefficient of thermal expansion materials than in relatively high modulus, high coefficient materials subjected to equal thermal gradients. The ability of the material to withstand thermally induced stresses is dependent upon the materials' strength. For ceramic materials in outer air seals, failure in tension as a result of thermal cycling is the common failure mode. Accordingly, tensile strength is plotted in the FIG. 3 graph.

As is viewable in the FIG. 3 graph of the twenty percent (20%) yttria stabilized zirconium oxide properties, modulus of elasticity (E) decreases sharply with increasing temperature of about eighteen hundred degrees Fahrenheit (1800° F.) and decreases less rapidly thereafter. Conversely, tensile strength (T) decreases only gradually with increasing temperature up to about two thousand degrees Fahrenheit (2000° F.) and more rapidly decreases thereafter. It is, therefore, that the ceramic material thus described by the above physical properties is well suited to applications in which the interface "A" temperature is limited to the approximate range of eighteen hundred to two thousand degrees Fahrenheit (1800°-2000° F.).

Figure 4:
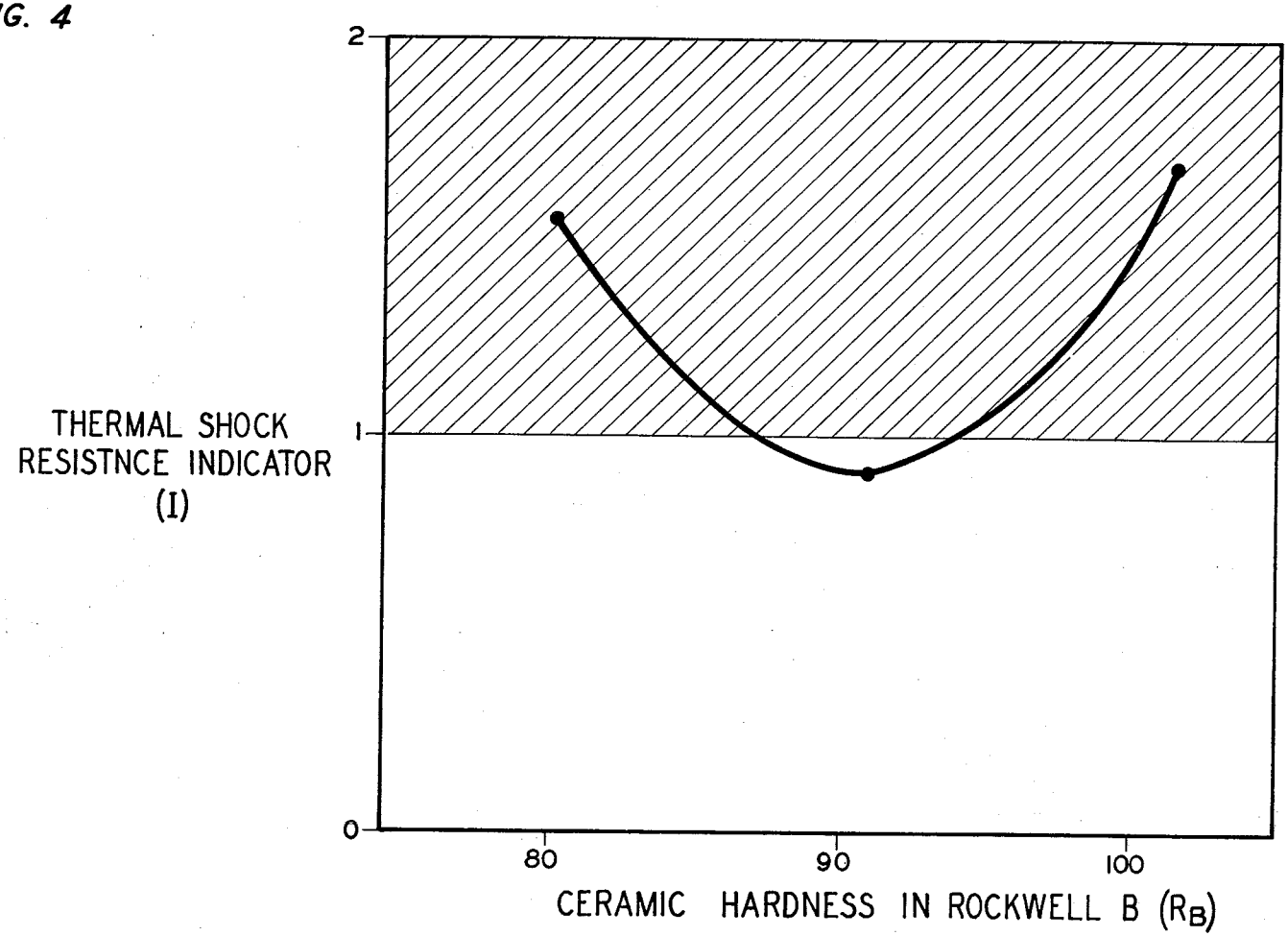
FIG. 4 compares the thermal shock resistance of one ceramic material sprayed to differing densities.

For purposes of comparison a thermal shock resistance indicator (I) for the same yttria stabilized zirconium oxide material applied at differing densities is calculated and plotted on the FIG. 4 graph. The shock indicator (I) is calculated to be the theoretical maximum stress to strength ratio ($\sigma$/T) in the ceramic material encountered during an engine operating cycle. The maximum value typically occurs in a transient condition such as during a six (6) second acceleration condition. A stress to strength ratio greater than one (1) indicates failure of the ceramic. Note on FIG. 4 that the stress to strength ratios of eighty (80) and one hundred (100) hard material exceed one (1) under the engine cycle proposed, whereas the stress to strength ratio of the ninety (90) hard material remains less than one (1).

In the present embodiment of the outer air seal structure, the porous pad was formed of an iron base alloy wire (FeCrAlSi) having a diameter of five to six thousandths of an inch (0.005-0.006 in.). The pad was compressed to a density of thirty-five percent (35%) wire material and sintered to establish at least a partial metallurgical bond between adjacent wires. A pad of sixty thousandths of an inch (0.060 in.) thick material was brazed to the substrate by conventional techniques. An underlayment of NiCrAlY alloy material consisting of 14-20 wt. % chromium;

11-13 wt. % aluminum;

0.10-0.70 wt. % yttrium;

2 wt. % maximum cobalt; and balance nickel was employed. An equivalent depth of coating, that is the depth of coating if applied to a flat surface, or approximately five thousandths of an inch (0.005 in.) was deposited into the wire pad. Other suitable underlayment materials are thought to include the nickel cobalt base alloy "NiCoCrAlY", the cobalt base alloy "CoCrAlY", and the iron base alloy "FeCrAlY", and the iron base alloy "FeCrAlY".

The effective application of underlayment material is important in securing good adhesion of the ceramic to the wire. The underlayment must penetrate into the wire pad and securely adhere to the wires. One suitable application technique is disclosed in copending U.S. patent application Ser. No. 38,042, filed May 11, 1979 to McComas et al entitled "Ceramic Faced Structures and Methods for Manufacture Thereof". In that technique underlayment particles are plasticized in a plasma stream and are accelerated in the stream to velocities on the order of four thousand feet per second (4000 fps). The high velocity enables the particles to penetrate into the porous wire pad. Collaterally, the temperature of the effluent in the described plasma spray process is substantially lower than that employed in conventional plasma spray processes. The relatively low temperatures employed prevent excessive preheating and resultant oxidation of the wire fibers in the pad before acceptable coatings can be deposited. Wire temperatures of less than one thousand degrees Fahrenheit (1000° F.) are generally required to assure that oxidation of the wires does not occur. Fiber temperatures restricted to a range of eight hundred to nine hundred degrees Fahrenheit (800°-900° F.) are preferred. Other deposition concepts may be employed in depositing the underlayment material to the porous pad.

Additionally, the ninety (90) hard ceramic material described herein has been found to exhibit adequate resistance to flowpath erosion. Eighty (80) hard material showed a greater tendency to erode. Although one hundred (100) hard material exhibited better erosion resistance than the ninety (90) hard material, the one hundred (100) hard material showed abradability characteristics inadequate to enable the desired close tolerancing of the seal/blade structure in most gas turbine engines. Ninety (90) hard material proved a good compromise between required abradability and erosion resistance.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of my invention, that which I claim as new and desire to secure by Letters Patent of the United States is:

1. An outer air seal of the type circumscribing the tips of rotor blades in the turbine section of a gas turbine engine, comprising:

a porous pad of flexible material having an arcuate contour; and a ceramic facing material which is adhered to the low modulus pad to form a blade tip opposing surface wherein said ceramic facing material is characterized by a modulus of elasticity at 1800° F. of approximately $1\times10^6$ lb/in$^2$;

mean tensile strength at 1800° F. of approximately 3450 lb/in$^2$;

coefficient of thermal expansion at 1800° F. of approximately $6.06\times10^{-6}$ in/in-°F.; and thermal conductivity at 1800° F. of approximately 5.55 Btu-in/hr-ft$^2$-°F.

2. The invention according to claim 1 wherein said ceramic facing material is yttria stabilized zirconium oxide consisting nominally of:

80 wt. % zirconium oxide ($ZrO_2$); and 20 wt. % yttrium oxide ($Y_2O_3$).

3. The invention according to claims 1 or 2 wherein said material is deposited to a true density which is approximately ninety-two percent (92%) of the material theoretical density.

4. The invention according to claims 1 or 2 wherein said facing material is characterized by a Rockwell B hardness ($R_B$) of approximately ninety (90).

5. The invention according to claim 1 which further includes a solid metallic substrate to which the porous pad is adhered.

6. The invention according to claim 5 which further includes an underlayment coating of MCrAlY type material which has been impregnated into the porous pad to provide a roughened surface for adherence of the ceramic.

7. The invention according to claim 6 wherein said ceramic facing material is yttria stabilized zirconium oxide consisting nominally of:

80 wt. % zirconium oxide ($ZrO_2$); and 20 wt. % yttrium oxide ($Y_2O_3$).

8. The invention according to claims 6 or 7 wherein said material is deposited to a true density which is approximately ninety-two percent (92%) of the material theoretical density.

9. The invention according to claims 6 or 7 wherein said facing material is characterized by a Rockwell B hardness ($R_B$) of approximately ninety (90).

* * * * *

UNITED STATES PATENT AND TRADEMARK OFFICE

CERTIFICATE OF CORRECTION

PATENT NO. : 4,289,446

DATED : September 15, 1981

INVENTOR(S) : Matthew J. Wallace

It is certified that error appears in the above-identified patent and that said Letters Patent are hereby corrected as shown below:

| | |
|---|---|
| Col. 1, line 19 | "and" should read -- of -- |
| Col. 3, line 36 | "motor" should read -- rotor -- |
| Col. 4, line 2 | "underlying" should read -- underlayment -- |
| Col. 5, line 48 | "of" should read -- to -- |
| Col. 6, lines 26 & 27 | "and the iron base alloy "FeCrAlY" (second occurrence) should be deleted |

Signed and Sealed this

*Thirteenth* Day of *April 1982*

[SEAL]

*Attest:*

GERALD J. MOSSINGHOFF

*Attesting Officer*

*Commissioner of Patents and Trademarks*